US011753799B2

(12) United States Patent
Miyamoto et al.

(10) Patent No.: US 11,753,799 B2
(45) Date of Patent: Sep. 12, 2023

(54) WORK VEHICLE

(71) Applicant: HITACHI CONSTRUCTION MACHINERY CO., LTD., Tokyo (JP)

(72) Inventors: Yasunori Miyamoto, Tsuchiura (JP); Tetsuji Tanaka, Abiko (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 14 days.

(21) Appl. No.: 17/638,296

(22) PCT Filed: Mar. 15, 2021

(86) PCT No.: PCT/JP2021/010316
§ 371 (c)(1),
(2) Date: Feb. 25, 2022

(87) PCT Pub. No.: WO2021/193187
PCT Pub. Date: Sep. 30, 2021

(65) Prior Publication Data

US 2022/0356677 A1 Nov. 10, 2022

(30) Foreign Application Priority Data

Mar. 23, 2020 (JP) ..... 2020-051505

(51) Int. Cl.
*E02F 9/22* (2006.01)
*E02F 9/26* (2006.01)
(Continued)

(52) U.S. Cl.
CPC ..... *E02F 9/2228* (2013.01); *E02F 9/2267* (2013.01); *E02F 9/26* (2013.01); *F15B 15/20* (2013.01); *E02F 3/283* (2013.01)

(58) Field of Classification Search
CPC ..... E02F 9/26; E02F 9/2228; E02F 9/2025; F15B 21/087; F15B 2211/633; F15B 2211/6346
See application file for complete search history.

(56) References Cited

U.S. PATENT DOCUMENTS 9,523,315 B2 * 12/2016 Hyodo ..... F02D 31/001
10,202,986 B2 * 2/2019 Tanaka ..... B62D 5/062
(Continued)

FOREIGN PATENT DOCUMENTS

JP 2000310202 A 11/2000
JP 2001-140678 A 5/2001
(Continued)

OTHER PUBLICATIONS

International Search Report of PCT/JP2021/010316 dated Jun. 8, 2021.

*Primary Examiner* — Thomas E Lazo
(74) *Attorney, Agent, or Firm* — MATTINGLY & MALUR, PC

(57) ABSTRACT

Provided is a work vehicle which can prevent an engine from stalling regardless of type of a system mounted on a vehicle body. In a wheel loader 1 equipped with a loading work device 11 operated by an electric operation lever 19, first and second directional control valves 5, 6 include neutral positions 5N, 6N for causing hydraulic oil discharged from a hydraulic pump 12 to return to a hydraulic oil tank 10, respectively, and in the case where a discharge pressure P of the hydraulic pump 12 is a main relief pressure Pr or more and an engine rotational speed N is less than a low idle rotational speed NL, a controller 2, 2A restricts the output of control signals to first and second solenoid control valves 3, 4 so as to cause the first and second directional control valves 5, 6 to be switched to the neutral positions 5N, 6N, respectively.

4 Claims, 7 Drawing Sheets

(51) Int. Cl.
*F15B 15/20* (2006.01)
*E02F 3/28* (2006.01)

(56) References Cited

U.S. PATENT DOCUMENTS

| | | | | |
|---|---|---|---|---|
| 2016/0319848 | A1* | 11/2016 | Tanaka | F15B 5/00 |
| 2020/0172158 | A1* | 6/2020 | Tanaka | B62D 5/07 |

FOREIGN PATENT DOCUMENTS

| | | | |
|---|---|---|---|
| JP | 2004150115 | A | 5/2004 |
| JP | 2010-76937 | A | 4/2010 |
| JP | 2015143545 | A | 8/2015 |
| JP | 6175377 | B2 | 8/2017 |
| JP | 2019173395 | A | 10/2019 |

* cited by examiner

WORK VEHICLE

TECHNICAL FIELD

The present invention relates to a work vehicle whose loading work device is operated by an electric operation lever.

BACKGROUND ART

In a work vehicle equipped with a work device, for example, a wheel loader, a hydraulic pump that discharges hydraulic oil for driving the work device and various other auxiliary devices are driven by an engine. Accordingly, when an operation of activating the work device while the engine is idle is performed, the total of the driving torque on the hydraulic pump side and the driving torque on the auxiliary devices side may exceed the output torque of the engine. If the load exceeding the output torque of the engine is applied to the engine, the engine would stall.

In recent years, low fuel consumption has been weighed heavily in fields of work vehicles, and thus the demand for technological development to reduce fuel consumption increases. In order to reduce the fuel consumption of a work vehicle, a method of selecting an engine with the output power corresponding to the minimum output torque required for driving the vehicle body can be an option. However, in the case of a work vehicle equipped with such an engine, as compared with a work vehicle equipped with an engine without being enhanced in light of reduction in fuel consumption, the load exceeding the output torque of the engine is easily to be applied to the engine, which may cause frequent engine stalling.

With this regard, for example, a wheel loader disclosed in Patent Literature 1 is designed, in the case where the load exceeding the output torque of the engine is applied to a hydraulic circuit for driving the work device and thus the actual rotational speed of the engine becomes less than the rotational speed of the engine in a state where the engine is running at the low idle rotational speed, to direct the hydraulic oil discharged from a hydraulic pump for work device to a tank through a load switching valve for regenerating a filter of an exhaust gas purification system so as to reduce the load applied to the engine, thereby preventing the engine from stalling.

CITATION LIST

Patent Literature

Patent Literature 1: JP-B-6175377

SUMMARY OF INVENTION

Technical Problem

The wheel loader according to Patent Literature 1 uses the load switching valve for eliminating clogging of the filter of the exhaust gas purifying system and regenerating the filter to unload the hydraulic oil discharged from the hydraulic pump for work device to the tank. However, for example, a work vehicle employing a selective catalytic reduction system (SCR system) as an exhaust gas processing system does not include a filter, and thus the load switching valve is not provided therein. Such a work vehicle needs to include a dedicated circuit for unloading the hydraulic oil discharged from the hydraulic pump for work device to the tank. Thus, the number of components to be mounted on the vehicle body increases, which results in increase in the size of the vehicle body and the limitation in the working space.

Therefore, an object of the present invention is to, in a work vehicle whose loading work device is operated by an electric operation lever, prevent an engine from stalling regardless of type of a system mounted on a vehicle body.

Solution to Problem

In order to solve the problem described above, the present invention provides a work vehicle comprising: a work device attached to a vehicle body; a hydraulic actuator configured to drive the work device; a hydraulic pump driven by an engine to supply the hydraulic actuator with hydraulic oil; a directional control valve configured to control a flow of the hydraulic oil discharged from the hydraulic pump and supplied to the hydraulic actuator; a hydraulic oil tank for storing the hydraulic oil; a solenoid control valve configured to supply the directional control valve with a control pressure for controlling and switching the directional control valve; an electric operation device for operating the work device; and a controller configured to output a control signal corresponding to an operation amount of the operation device to the solenoid control valve, wherein the work vehicle includes: a pressure sensor configured to detect a discharge pressure of the hydraulic pump; and a rotational speed sensor configured to detect a rotational speed of the engine, the directional control valve includes a neutral position for causing the hydraulic oil discharged from the hydraulic pump to return to the hydraulic oil tank, and the controller is configured to, in a case where the discharge pressure detected by the pressure sensor is equal to or more than a relief pressure in a drive circuit of the hydraulic actuator, and the rotational speed detected by the rotational speed sensor is less than a low idle rotational speed that is a rotational speed in a state where the engine is running at a low idle speed, execute restriction of output of the control signal to the solenoid control valve so as to cause the directional control valve to be switched to the neutral position.

Advantageous Effects of Invention

According to the present invention, in a work vehicle whose loading work device is operated by an electric operation lever, it is possible to prevent an engine from stalling regardless of type of a system mounted on the vehicle body. The problems, configurations, and advantageous effects other than those described above will be clarified by explanation of the embodiment below.

DESCRIPTION OF EMBODIMENTS

Hereinafter, as an aspect of work vehicles according to an embodiment of the present invention, for example, a wheel loader for performing loading work by excavating earth and sand and minerals in open-pit mines and loading the excavated materials into such as a dump truck will be described.

<Configuration of Wheel Loader 1>

Firstly, a configuration of a wheel loader 1 will be described with reference to FIG. 1.

Figure 1:
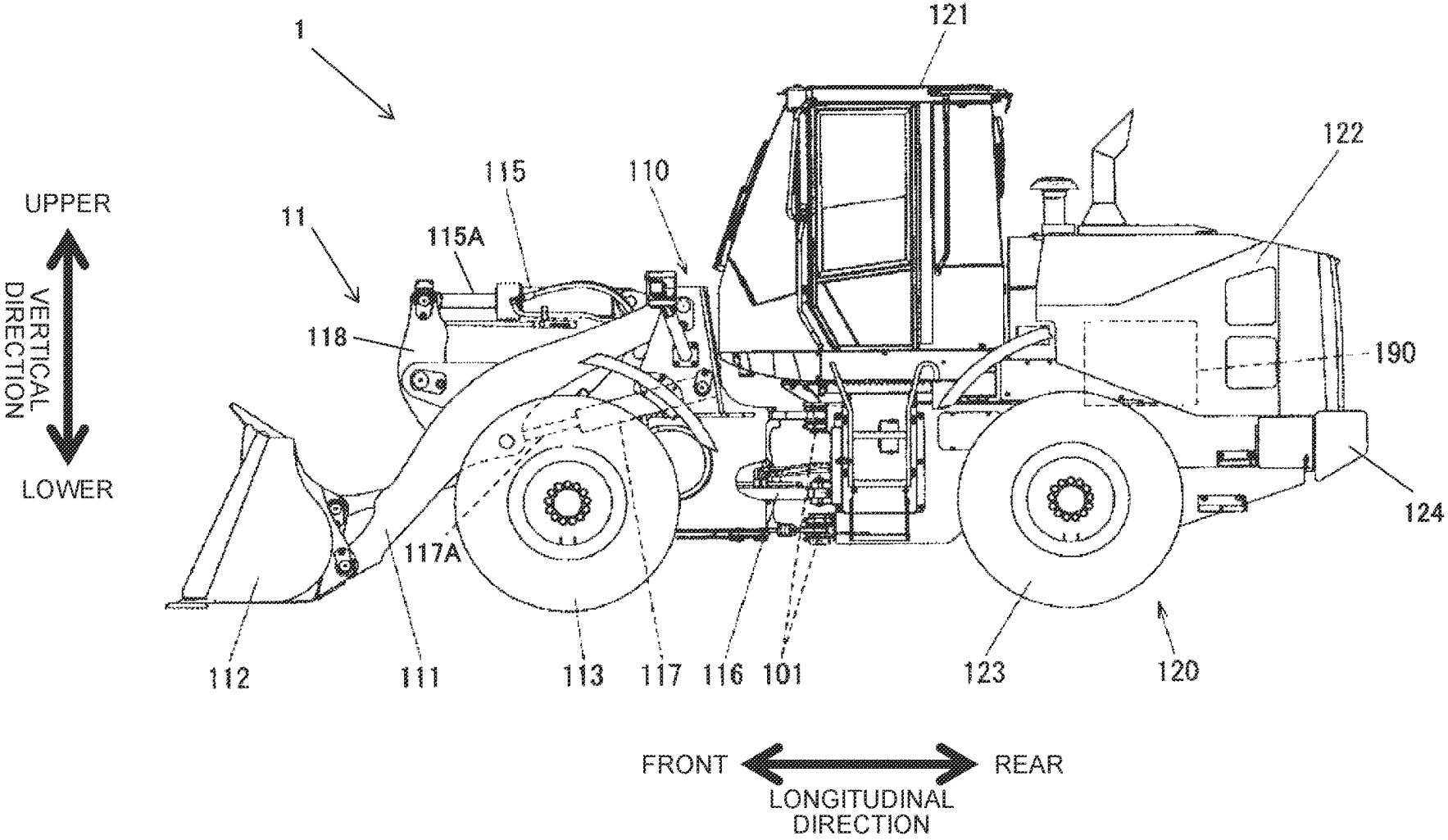
FIG. 1 is a side view of an appearance illustrating a configuration example of a wheel loader according to an embodiment of the present invention.

FIG. 1 is a side view of an appearance illustrating a configuration example of the wheel loader 1 according to the embodiment of the present invention.

The wheel loader 1 is an articulated type work vehicle which is swiveled on a central portion of the vehicle body and steered thereby. Specifically, a front frame 110 that is the front part of the vehicle body and a rear frame 120 that is the rear part of the vehicle body are connected to each other by a center pin 101 to swivel in the left and right direction so that the front frame 110 is bent in the left and right direction with respect to the rear frame 120 in accordance with extension and contraction of a rod of a steering cylinder 116. In the following, the left hand side in a state where the vehicle body is oriented in the forward direction is referred to as the "left direction", and the right hand side which is opposite thereto is referred to as the "right direction".

The front frame 110 includes a pair of left and right front wheels 113, and the rear frame 120 includes a pair of left and right rear wheels 123, respectively, that is, the vehicle body includes the four wheels 113, 123 in total. Note that FIG. 1 illustrates, among the four wheels 113, 123, only the front wheel 113 and the rear wheel 123 provided on the left side.

On the front frame 110, a hydraulically driven loading work device 11 used for the loading work is mounted. The loading work device 11 includes a lift arm 111 whose proximal end portion is pivotably attached to the front frame 110, two lift arm cylinders 117 for driving the lift arm 111 in accordance with extension and contraction of each of rods 117A, a bucket 112 pivotably attached to the distal end portion of the lift arm 111, a bucket cylinder 115 for driving the bucket 112 in accordance with extension and contraction of a rod 115A, and a bell crank 118 pivotably connected to the lift arm 111 and forming a link mechanism between the bucket 112 and the bucket cylinder 115.

When each of the two arm cylinders 117 is supplied with hydraulic oil discharged from a hydraulic pump 12 (see FIG. 2), the lift arm 111 is pivotably moved in the upper direction with respect to the front frame 110 in accordance with extension of each of the rods 117A, and is pivotably moved in the lower direction with respect to the front frame 110 in accordance with contraction of each of the rods 117A. Although the two lift arm cylinders 117 are arranged side by side in the lateral direction of the vehicle body, FIG. 1 illustrates only one of the lift arm cylinders 117 which is disposed on the left side by a broken line.

The bucket 112 is a work tool used to scoop and discharge earth and sand and level the ground. When the bucket cylinder 115 is supplied with hydraulic oil discharged from the hydraulic pump 12, the bucket 112 is pivotably moved in the upper direction (tilt) with respect to the lift arm 111 in accordance with extension of the rod 115A, and is pivotably moved in the lower direction (dump) with respect to the lift arm 111 in accordance with contraction of the rod 115A. Note that each of the bucket cylinder 115 and the two lift arm cylinders 117 corresponds to a hydraulic actuator for driving the loading work device 11.

The rear frame 120 includes an operator's cab 121 provided for an operator to get in, a machine room 122 for accommodating therein respective devices necessary for driving the wheel loader 1, and a counterweight 124 for balancing the vehicle body with the loading work device 11 to prevent the vehicle body from tilting. On the rear frame 120, the operator's cab 121 is provided in the front thereof, the counterweight 124 is provided in the rear thereof, and the machine room 122 is provided between the operator's cab 121 and the counterweight 124.

<Drive system of the loading work device 11>

Next, a drive system of the loading work device 11 will be described with reference to FIG. 2.

Figure 2:
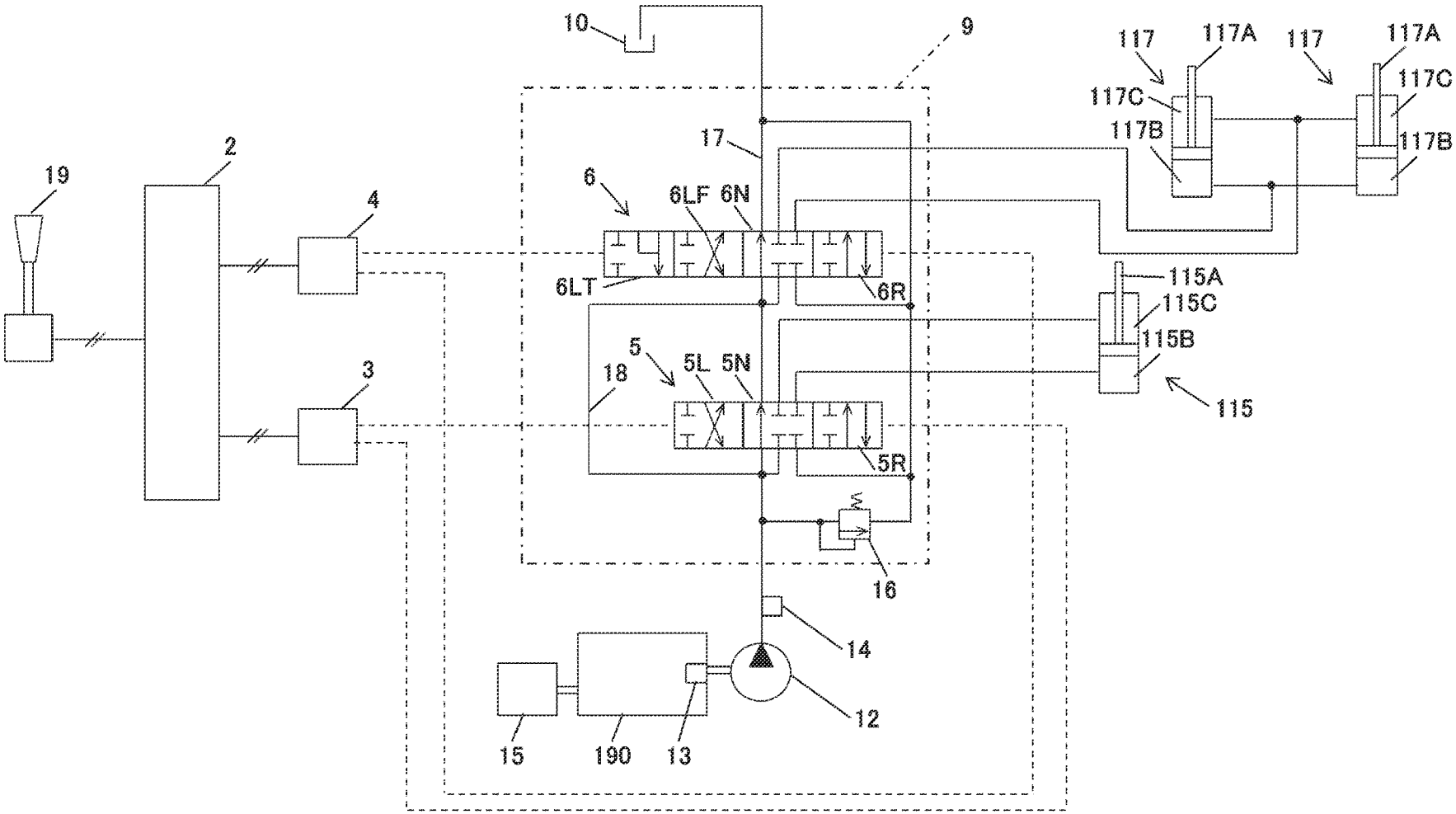
FIG. 2 is a system configuration diagram illustrating a configuration of a drive system of a loading work device.

FIG. 2 is a system configuration diagram illustrating a configuration of the drive system of the loading work device 11.

The drive system of the loading work device 11 includes the bucket cylinder 115, the two lift arm cylinders 117, the hydraulic pump 12 for supplying hydraulic oil to each of the cylinders 115, 117, a directional control valve device 9 configured to control a flow (direction and flow rate) of the hydraulic oil discharged from the hydraulic pump 12 and supplied to each of the cylinders 115, 117, and a hydraulic oil tank 10 for storing the hydraulic oil.

The hydraulic pump 12 is a fixed displacement hydraulic pump driven by an engine 190. A discharge pressure P of the hydraulic pump 12 is detected by a pressure sensor 14 mounted to a discharge port of the hydraulic pump 12. A rotational speed N of the engine 190 is detected by a rotational speed sensor 13 mounted to an output shaft of the engine 190. The engine 190 also drives an auxiliary device 15 other than the hydraulic pump 12.

The directional control valve device 9 includes a first directional control valve 5 configured to switch and control the flow of the hydraulic oil discharged from the hydraulic pump 12 and supplied to the bucket cylinder 115, a second directional control valve 6 configured to switch and control the flow of the hydraulic oil discharged from the hydraulic pump 12 and supplied to each of the two lift arm cylinders 117, and a main relief valve 16 configured to define the maximum pressure in the directional control valve device 9, in other words, a relief pressure Pr in the drive circuits of each of the bucket cylinder 115 and the two lift arm cylinders 117. Note that the relief pressure Pr in the drive circuits of each of the bucket cylinder 115 and the two lift arm cylinders 117 can be arbitrarily set to a predetermined value, and hereinafter, is simply referred to as "main relief pressure Pr".

Each of the first directional control valve 5 and the second directional control valve 6 is an open center directional control valve, and is provided on a center bypass line 17 connecting the hydraulic pump 12 and the hydraulic oil tank 10. The second directional control valve 6 is connected in parallel with the first directional control valve 5 by a parallel line 18 which branches from the center bypass line 17 on the upstream side of the first directional control valve 5 and is connected thereto on the upstream side of the second directional control valve 6.

The first directional control valve 5 includes a first switching position 5L, a neutral position 5N, and a second switching position 5R. The first switching position 5L causes the hydraulic oil discharged from the hydraulic pump 12 to flow into a bottom chamber 115B of the bucket cylinder 115, and directs the hydraulic oil discharged from a rod chamber 115C to the hydraulic oil tank 10. The neutral position 5N causes the hydraulic oil discharged from the hydraulic pump 12 to directly return to the hydraulic oil tank 10. The second switching position 5R causes the hydraulic oil discharged from the hydraulic pump 12 to flow into the rod chamber 115C of the bucket cylinder 115, and directs the hydraulic oil discharged from the bottom chamber 115B to the hydraulic oil tank 10.

Each of the first switching position 5L, the neutral position 5N, and the second switching position 5R is switched in accordance with displacement of a spool provided inside the first directional control valve 5. The spool is displaced in proportion to the control pressure supplied from a first solenoid control valve 3. Thus, by controlling the control pressure supplied from the first solenoid control valve 3, it is possible to control the displacement of the spool between the first switching position 5L and the neutral position 5N, and between the second switching position 5R and the neutral position 5N.

In each of a state where the first directional control valve 5 is switched to the first switching position 5L and a state where it is switched to the second switching position 5R, the displacement volume of the spool takes the maximum (full stroke state). In a state where the first directional control valve 5 is switched to the neutral position 5N, the displacement volume of the spool is 0, and the spool stops at neutral. At this time, the first solenoid control valve 3 stops supplying the control pressure.

When the spool is displaced between the first switching position 5L and the neutral position 5N, a part of the hydraulic oil discharged from the hydraulic pump 12 flows into the bottom chamber 115B of the bucket cylinder 115, and the remaining hydraulic oil directly returns to the hydraulic oil tank 10 through the center bypass line 17. Thus, by restricting the supply of the control pressure from the state where the first directional control valve 5 has been switched to the first switching position 5L, a part of the hydraulic oil discharged from the hydraulic pump 12 is unloaded to the hydraulic oil tank 10.

In the same manner, when the spool is displaced between the second switching position 5R and the neutral position 5N, a part of the hydraulic oil discharged from the hydraulic pump 12 flows into the rod chamber 115C of the bucket cylinder 115, and the remaining hydraulic oil directly returns to the hydraulic oil tank 10 through the center bypass line 17. Thus, by restricting the supply of the control pressure from the state where the first directional control valve 5 has been switched to the second switching position 5R, a part of the hydraulic oil discharged from the hydraulic pump 12 is unloaded to the hydraulic oil tank 10.

The bucket 112 is operated by an operation lever 19 serving as an electric operation device for operating the loading work device 11. For example, when the operation lever 19 is operated in a direction for causing the bucket 112 to dump, a bucket operation signal relating to a dump operation of the bucket 112 is output from the operation lever 19 to a controller 2.

The controller 2 outputs a control signal corresponding to a dump operation amount of the bucket 112 to the first solenoid control valve 3 based on the received bucket operation signal. Then, the first solenoid control valve 3 supplies the first directional control valve 5 with the control pressure for controlling and switching the first directional control valve 5 to the second switching position 5R. Thus, the first directional control valve 5 is switched to the second switching position 5R, and the hydraulic oil is discharged from the bottom chamber 115R of the bucket cylinder 115, whereby the rod 115A contracts and the bucket 112 dumps.

The second directional control valve 6 includes a first switching position 6LF, a neutral position 6N, a second switching position 6R, and a third switching position 6LT. The first switching position 6LF causes the hydraulic oil discharged from the hydraulic pump 12 to flow into each of rod chambers 117C of the two lift arm cylinders 117, and directs the hydraulic oil discharged from each of bottom chambers 117B to the hydraulic oil tank 10. The neutral position 6N causes the hydraulic oil discharged from the hydraulic pump 12 to directly return to the hydraulic oil tank 10. The second switching position 6R causes the hydraulic oil discharged from the hydraulic pump 12 to flow into each of the bottom chambers 117B of the two lift arm cylinders 117, and directs the hydraulic oil discharged from each of the rod chambers 117C to the hydraulic oil tank 10. The third switching position 6LT directs the hydraulic oil discharged from each of the bottom chambers 117B and the rod chambers 117C of the two lift arm cylinders 117 to the hydraulic oil tank 10.

Each of the first switching position 6LF, the neutral position 6N, the second switching position 6R, and the third switching position 6LT is switched in accordance with displacement of a spool provided inside the second directional control valve 6. The spool is displaced in proportion to the control pressure supplied from a second solenoid control valve 4. Thus, by controlling the control pressure supplied from the second solenoid control valve 4, it is possible to control the displacement of the spool between the first switching position 6LF and the neutral position 6N, and between the second switching position 6R and the neutral position 6N.

In each of a state where the second directional control valve 6 is switched to the third switching position 6LT and a state where it is switched to the second switching position 6R, the displacement volume of the spool takes the maximum (full stroke state). In a state where the second directional control valve 6 is switched to the neutral position 6N, the displacement volume of the spool is 0, and the spool stops at neutral. At this time, the second solenoid control valve 4 stops supplying the control pressure.

When the spool is displaced between the first switching position 6LF and the neutral position 6N, a part of the hydraulic oil discharged from the hydraulic pump 12 flows into each of the bottom chambers 117B of the two lift arm cylinders 117, and the remaining hydraulic oil directly returns to the hydraulic oil tank 10 through the center bypass line 17. Thus, by restricting the supply of the control pressure from the state where the second directional control valve 6 has been switched to the first switching position 6LF, a part of the hydraulic oil discharged from the hydraulic pump 12 is unloaded to the hydraulic oil tank 10.

In the same manner, when the spool is displaced between the second switching position 6R and the neutral position 6N, a part of the hydraulic oil discharged from the hydraulic pump 12 flows into each of the rod chambers 117C of the two lift arm cylinders 117, and the remaining hydraulic oil directly returns to the hydraulic oil tank 10 through the center bypass line 17. Thus, by restricting the supply of the control pressure from the state where the second directional control valve 6 has been switched to the second switching position 6R, a part of the hydraulic oil discharged from the hydraulic pump 12 is unloaded to the hydraulic oil tank 10.

The lift arm 111 is operated by the operation lever 19. That is, in the present embodiment, both the lift arm 111 and the bucket 112 are operated by the operation lever 19. However, the present invention is not limited thereto, and separate operation levers may be used to operate the lift arm 111 and the bucket 112, respectively. For example, when the operation lever 19 is operated in a direction for raising the lift arm 111, a lift arm operation signal relating to a raise operation of the lift arm 111 is output from the operation lever 19 to the controller 2.

The controller 2 outputs a control signal corresponding to a raise operation amount of the lift arm 111 to the second solenoid control valve 4 based on the received lift arm operation signal. Then, the second solenoid control valve 4 supplies the second directional control valve 6 with the control pressure for controlling and switching the second directional control valve 6 to the first switching position 6LF. Thus, the second directional control valve 6 is switched to the first switching position 6LF, and the hydraulic oil flows into each of the bottom chambers 117B of the two lift arm cylinders 117, whereby each of the rods 117A extends and the lift arm 111 is raised.

<Configuration of Controller 2>

Next, a configuration of the controller 2 will be described with reference to FIG. 3.

Figure 3:
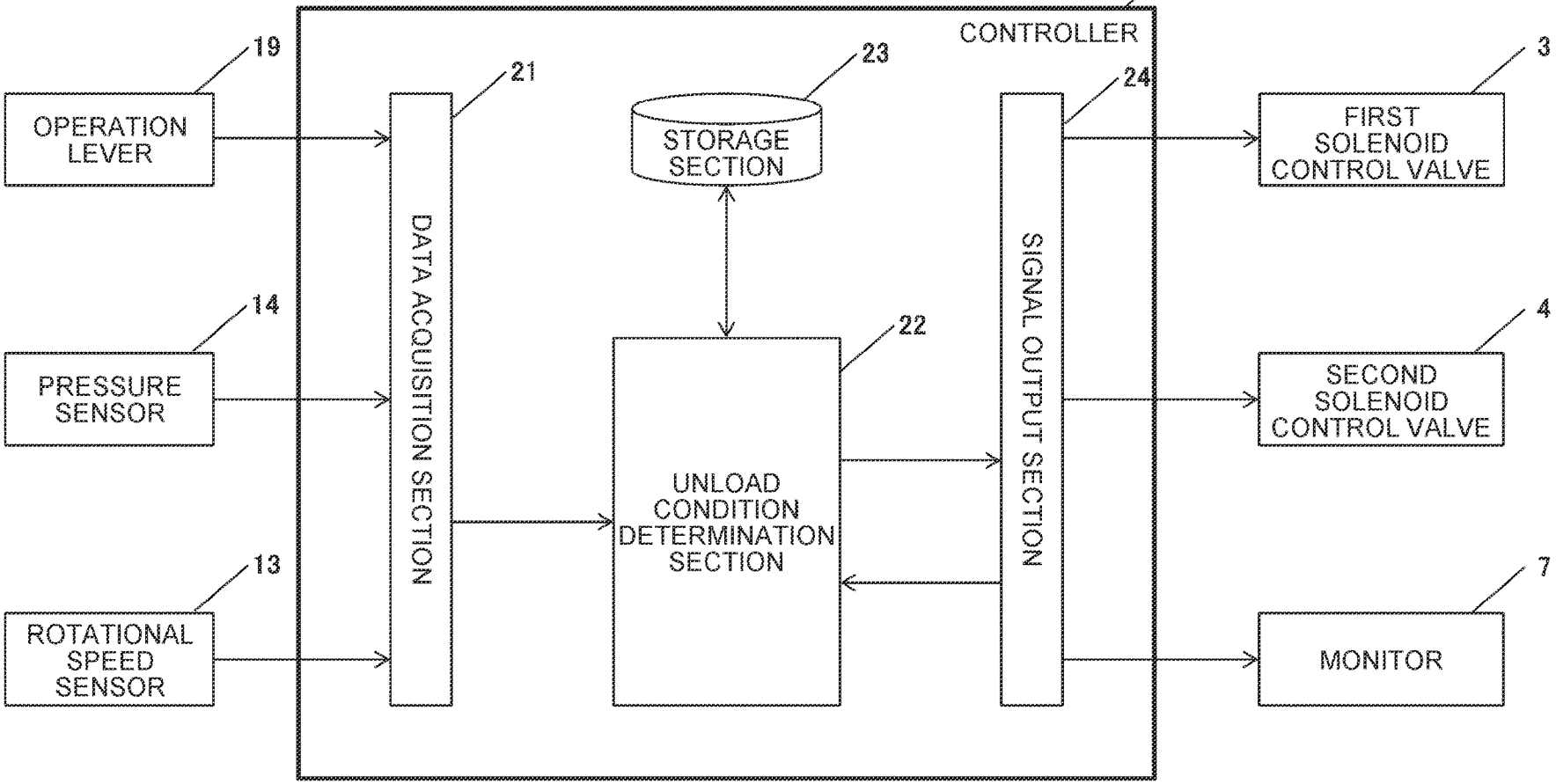
FIG. 3 is a functional block diagram illustrating functions of a controller.

FIG. 3 is a functional block diagram illustrating the functions of the controller 2.

The controller 2 is configured such that a CPU, a RAM, a ROM, an HDD, an input I/F, and an output I/F are connected to each other via a bus. Then, various operation devices such as the operation lever 19, and various sensors such as the pressure sensor 14 and the rotational speed sensor 13 are connected to the input I/F, and the first solenoid control valve 3, the second solenoid control valve 4, and a monitor 7 are connected to the output I/F. Note that the monitor 7 is provided in the operator's cab 121, and configured to display, as an advice display, that the controller 2 is restricting the output of the control signals to the first solenoid control valve 3 and the second solenoid control valve 4.

In this hardware configuration, the CPU reads out a control program (software) stored in a recording medium such as the ROM, the HDD or an optical disc, and loads and executes the control program on the RAM, whereby the control program and the hardware collaborate to implement the functions of the controller 2.

In the present embodiment, the controller 2 is described as a computer configured by a combination of software and hardware. However, the controller 2 is not limited thereto, and as one of the examples of configurations of other computers, an integrated circuit for implementing the functions of the control program executed on the side of the wheel loader 1 may be used.

The controller 2 includes a data acquisition section 21, an unload condition determination section 22, a storage section 23, and a signal output section 24.

The data acquisition section 21 is configured to acquire data relating to the operation signal output from the operation lever 19 in accordance with the operation amount, the discharge pressure P of the hydraulic pump 12 (hereinafter, simply referred to as "discharge pressure P") detected by the pressure sensor 14, and the rotational speed N of the engine 190 (hereinafter, simply referred to as "engine rotational speed N") detected by the rotational speed sensor 13, respectively.

The unload condition determination section 22 is configured to determine whether an unload condition is satisfied. The unload condition is that the discharge pressure P acquired by the data acquisition section 21 is equal to or more than the main relief pressure Pr (PPr), and that the engine rotational speed N acquired by the data acquisition section 21 is less than a low idle rotational speed NL that is the rotational speed in a state where the engine 190 is running at the low idle rotational speed (N<NL). Note that the main relief pressure Pr and the low idle rotational speed NL are stored in the storage section 23 serving as a memory.

Here, "in the case where the unload condition is satisfied" means that the state where the load exceeding the output torque of the engine 190 is applied to the engine 190 due to driving of the loading work device 11 and thus the engine 190 would stall.

The "low idle rotational speed NL" is, specifically, the engine rotational speed set in consideration of fuel consumption, and is also applied during work. That is, the "low idle rotational speed NL" is the engine rotational speed set to the minimum required to prevent the engine 190 from stalling even when the workload is applied.

Figure 7A:
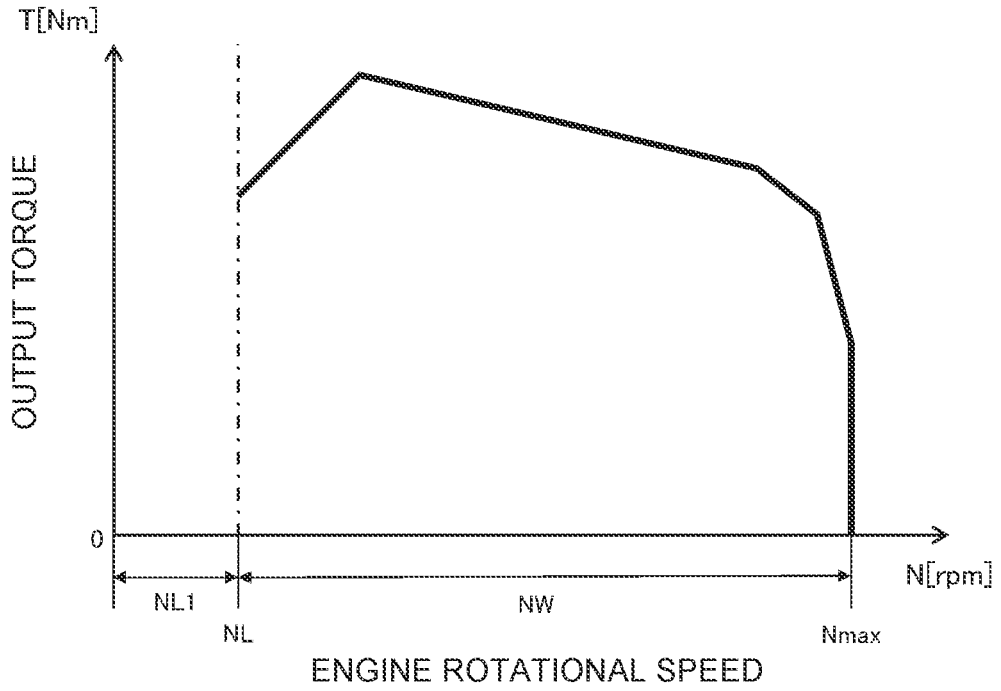
FIG. 7 illustrates a graph showing the relation between the engine rotational speed and the output torque.
Figure 7B:
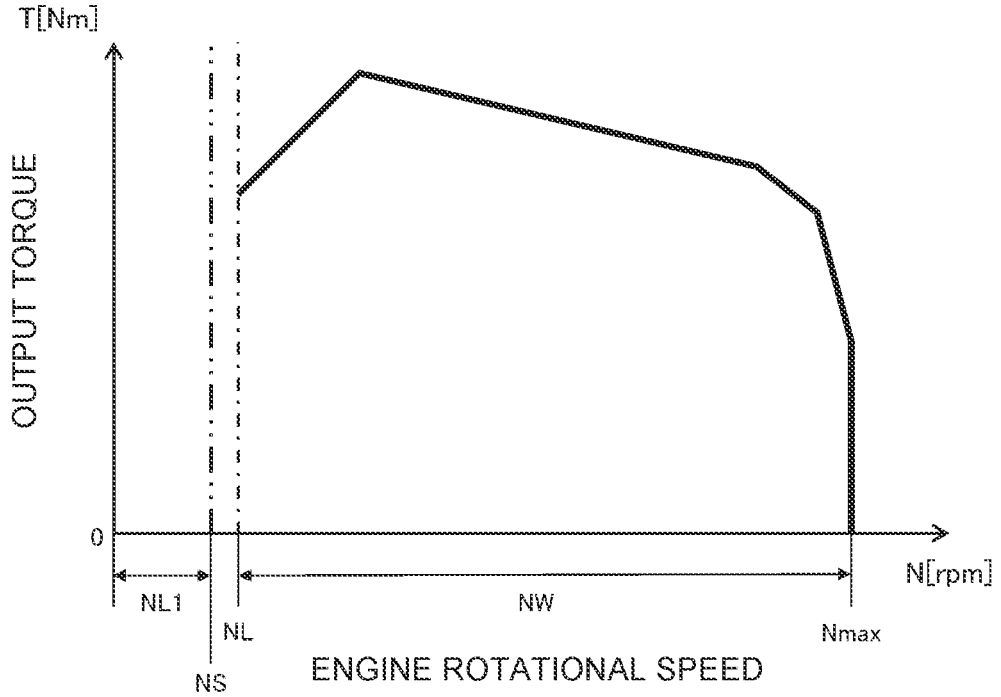

Here, each of FIG. 7A and FIG. 7B illustrates a graph showing the relation between the engine rotational speed and the output torque. As illustrated in FIG. 7A and FIG. 7B, the engine rotational speed that is less than the low idle rotational speed NL corresponds to an engine rotational speed NL1 that is equal to or more than the minimum engine rotational speed (=0) and is less than the low idle rotational speed NL (0≤NL1<NL). Note that, as illustrated in FIG. 7B, a rotational speed NS that is slightly less than the low idle rotational speed NL may be set as the maximum value of the engine rotational speed NL1. In this case, the unload condition determination section 22 does not immediately determine that the unload condition is satisfied even when the engine rotational speed N becomes less than the low idle rotational speed NL, but determines that the unload condition is satisfied only when the engine rotational speed N reaches the rotational speed NS. Thus, by setting the rotational speed NS to which a margin from the low idle rotational speed NL is provided as the maximum value of the engine rotational speed NL1, it is possible to avoid hunting of the engine rotational speed.

Furthermore, as illustrated in FIG. 7A and FIG. 7B, the engine rotational speed that is equal to or more than the low idle rotational speed NL corresponds to an engine rotational speed NW to be applied during work, and is set in a range from the low idle rotational speed NL to the maximum engine rotational speed Nmax (NL≤NW≤Nmax). Note that the maximum engine rotational speed Nmax during work is set to the engine rotational speed that takes the maximum at no load.

The signal output section 24 is configured to, when the unload condition determination section 22 determines that the unload condition is not satisfied, output control signals based on an operation signal acquired by the data acquisition section 21 to the first solenoid control valve 3 and the second solenoid control valve 4. When the unload condition determination section 22 determines that the unload condition is satisfied, the signal output section 24 restricts the output of the control signals to the first solenoid control valve 3 and the second solenoid control valve 4.

In the present embodiment, after the signal output section 24 restricts the output of the control signals to the first solenoid control valve 3 and the second solenoid control valve 4, the unload condition determination section 22 determines whether the engine rotational speed N acquired again by the data acquisition section 21 is equal to or more than the low idle rotational speed NL. When the unload condition determination section 22 determines that the engine rotational speed N is equal to or more than the low idle rotational speed NL (N≥NL), the signal output section 24 cancels the restriction of the output of the control signals to the first solenoid control valve 3 and the second solenoid control valve 4.

Furthermore, in the present embodiment, in the case where the output of the control signals to the first solenoid control valve 3 and the second solenoid control valve 4 has been restricted, the signal output section 24 outputs a display signal for displaying the advice display described above to the monitor 7. Then, when cancelling the restriction of the output of the control signals to the first solenoid control valve 3 and the second solenoid control valve 4, the signal output section 24 stops the output of the display signal to the monitor 7.

<Processing in Controller 2>

Next, a flow of the processing executed in the controller 2 will be described with reference to FIG. 4.

Figure 4:
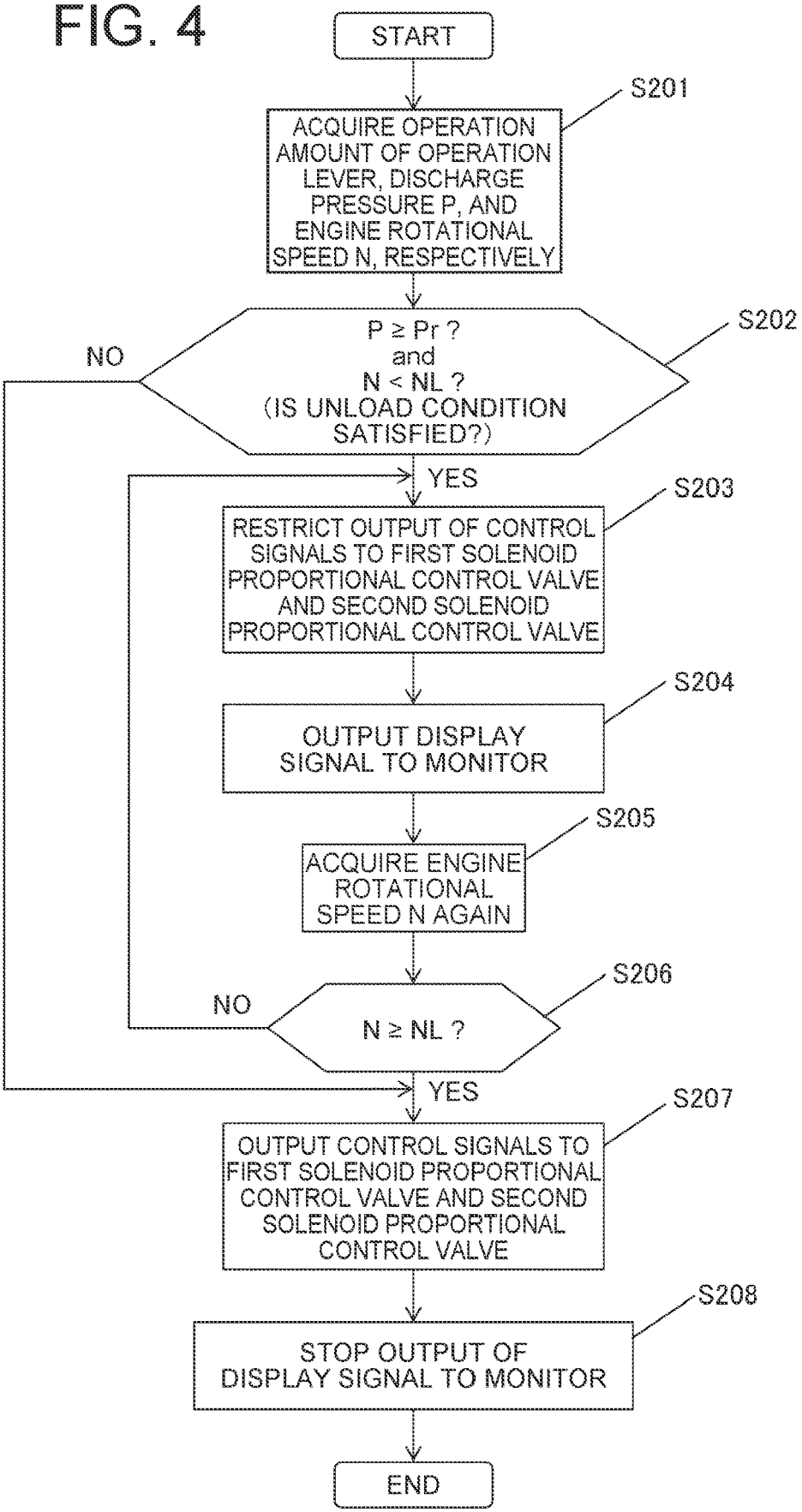
FIG. 4 is a flowchart illustrating a flow of the processing executed by the controller.

FIG. 4 is a flowchart illustrating a flow of the processing executed by the controller 2.

Firstly, the data acquisition section 21 acquires the operation signal output from the operation lever 19 in accordance with the operation amount, the discharge pressure P detected by the pressure sensor 14, and the engine rotational speed N detected by the rotational speed sensor 13, respectively (step S201).

Next, the unload condition determination section 22 determines whether the discharge pressure P acquired in step S201 is equal to or more than the main relief pressure Pr, and whether the engine rotational speed N acquired in step S201 is the engine rotational speed NL1 that is less than the low idle rotational speed NL, that is, determines whether the unload condition is satisfied (step S202).

In step S202, when it is determined that the discharge pressure P is equal to or more than the main relief pressure Pr (P≥Pr) and the engine rotational speed N is the engine rotational speed NL1 that is less than the low idle rotational speed NL (N=NL1<NL), that is, when it is determined that the unload condition is satisfied (step S202/YES), the signal output section 24 restricts the output of the control signals to the first solenoid control valve 3 and the second solenoid control valve 4 (step S203).

Since the first solenoid control valve 3 and the second solenoid control valve 4 restrict the supply of the control pressure to the first directional control valve 5 and the second directional control valve 6, the spool of the first directional control valve 5 and that of the second directional control valve 6 are displaced toward the neutral positions 5N, 6N, respectively. Thus, at least a part of the hydraulic oil discharged from the hydraulic pump 12 returns (is unloaded) into the hydraulic oil tank 10 through the center bypass line 17, thereby reducing the load applied to the engine 190 and thus preventing the engine 190 from stalling.

Furthermore, in the case of the wheel loader 1, the controller 2 is configured to restrict the output of the control signals to the first solenoid control valve 3 and the second solenoid control valve 4 so as to unload the hydraulic oil discharged from the hydraulic pump 12 to the hydraulic oil tank 10, and since the first solenoid control valve 3 and the second solenoid control valve 4 are devices which are necessarily mounted on the vehicle body whose loading work device 11 is operated by the electric operation lever 19, regardless of type of a system mounted on the vehicle body, it is possible to prevent the engine 190 from stalling.

Subsequently, during the restriction of the output of the control signals to the first solenoid control valve 3 and the second solenoid control valve 4, the signal output section 24 outputs a display signal for displaying the advice display to the monitor 7 (step S204). Thus, the operator can recognize that the controller 2 is restricting the output of the control signals to the first solenoid control valve 3 and the second solenoid control valve 4 by looking at the advice display on the monitor 7.

Next, in the present embodiment, the data acquisition section 21 acquires the engine rotational speed N detected by the rotational speed sensor 13 again (step S205). Subsequently, the unload condition determination section 22 determines whether the engine rotational speed N acquired again in step S205 is the engine rotational speed NW that is equal to or more than the low idle rotational speed NL (step S206).

When it is determined in step S206 that the engine rotational speed N is the engine rotational speed NW that is equal to or more than the low idle rotational speed NL (N=NW≥NL) (step S206/YES), the signal output section 24 cancels the restriction of the output of the control signals to the first solenoid control valve 3 and the second solenoid control valve 4, that is, outputs control signals corresponding to the operation amount of the operation lever 19 (step S207). In this case, since the engine 190 hardly stalls, the hydraulic oil discharged from the hydraulic pump 12 is prevented from being unloaded to the hydraulic oil tank 10 more than necessary so as to ensure the operation of the loading work device 11.

Then, the signal output section 24 stops the output of the display signal to the monitor 7 (step S208), and the processing in the controller 2 is completed. Since the advice display which has been displayed on the monitor 7 is hidden, the operator can easily recognize that the restriction of the output of the control signals to the first solenoid control valve 3 and the second solenoid control valve 4 is cancelled. Note that a specific method of displaying the advice display on the monitor 7 is not particularly limited.

On the other hand, when it is determined in step S206 that the engine rotational speed N is the engine rotational speed NL1 that is less than the low idle rotational speed NL (N=NL1<NL) (step S206/NO), the processing returns to step S203, and the signal output section 24 continues to restrict the output of the control signals to the first solenoid control valve 3 and the second solenoid control valve 4.

Note that it is determined in step S202 that the discharge pressure P is less than the main relief pressure Pr (P<Pr), or the engine rotational speed N is the engine rotational speed NW that is equal to or more than the low idle rotational speed NL (N=NW≥NL), that is, when it is determined that the unload condition is not satisfied (step S202/NO), the load applied to the engine 190 is not too heavy and thus the engine 190 hardly stalls. Accordingly, the processing proceeds to step S207, and the signal output section 24 outputs the control signals corresponding to the operation amount of the operation lever 19 to the first solenoid control valve 3 and the second solenoid control valve 4.

<Modification>

Figure 5:
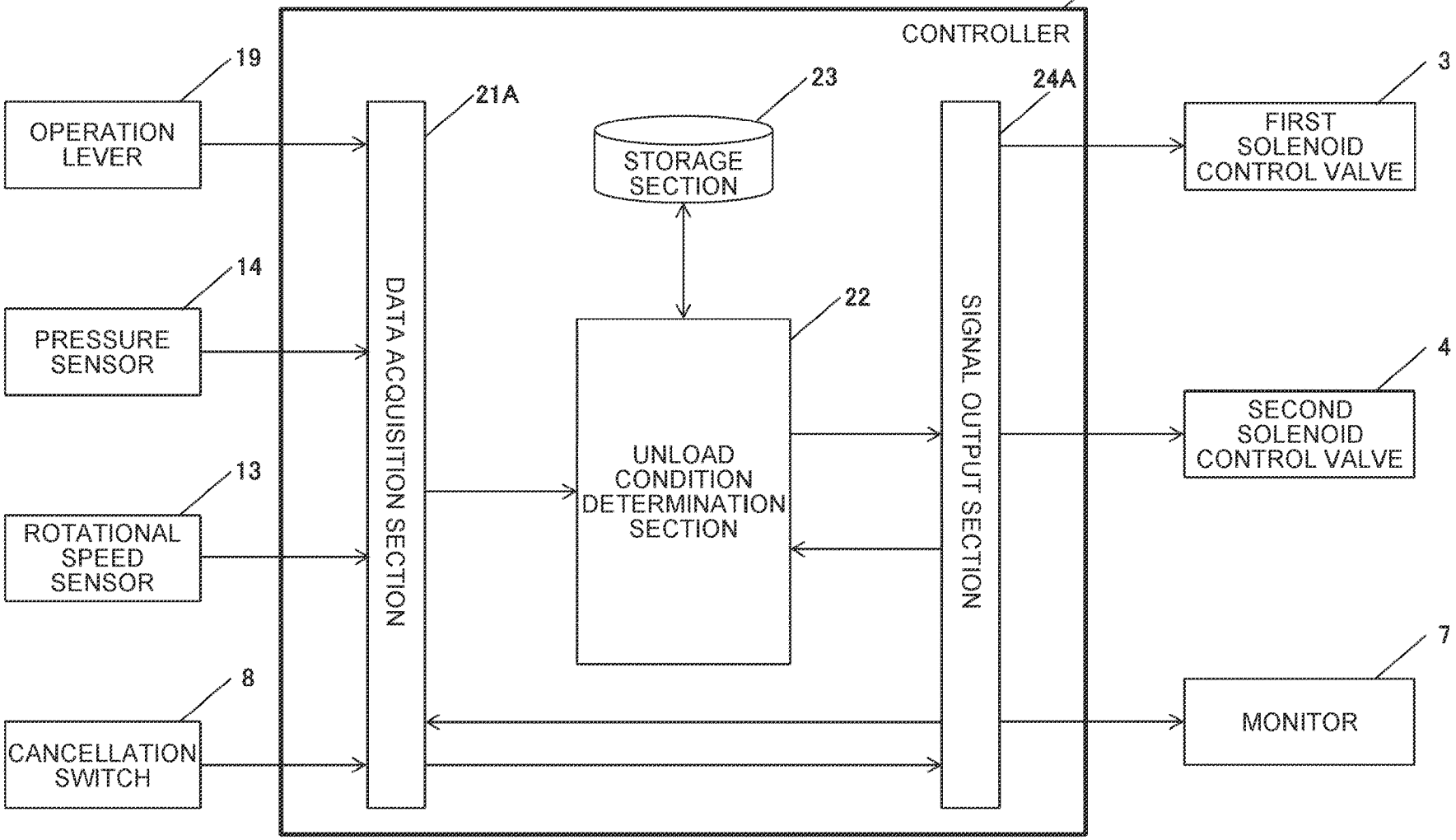
FIG. 5 is a functional block diagram illustrating functions of a controller according to a modification of the present invention.
Figure 6:
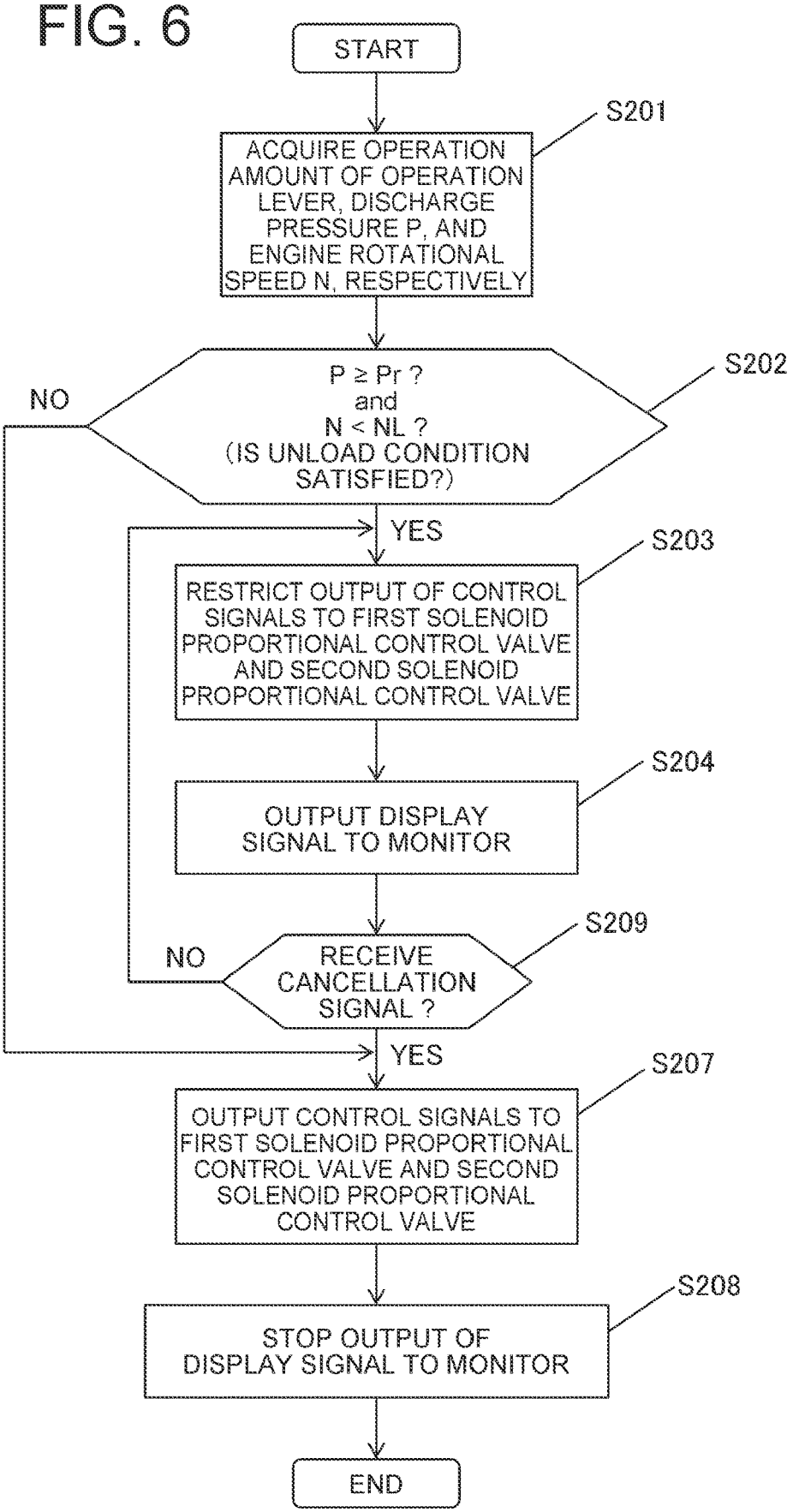
FIG. 6 is a flowchart illustrating a flow of the processing executed by the controller according to the modification of the present embodiment.

Next, the wheel loader 1 according to a modification of the present invention will be described with reference to FIG. 5 and FIG. 6. In FIG. 5 and FIG. 6, the same components as those of the wheel loader 1 according to the embodiment described above are provided with the same reference signs, and the explanation therefor will be omitted.

FIG. 5 is a functional block diagram illustrating the functions of a controller 2A according to the modification of the present invention. FIG. 6 is a flowchart illustrating a flow of the processing executed by the controller 2A according to the modification of the present embodiment.

The wheel loader 1 according to the present modification includes a cancellation switch 8 as a cancellation device for outputting, to the controller 2A, a cancellation signal for cancelling the restriction of the output of the control signals to the first solenoid control valve 3 and the second solenoid control valve 4. The cancellation switch 8 is provided in the operator's cab 121 (see FIG. 1) and is manually operated by an operator.

As illustrated in FIG. 5, the cancellation signal output from the cancellation switch 8 is input to the data acquisition section 21A of the controller 2A. As illustrated in FIG. 6, the controller 2A is configured to, after the signal output section 24A restricts the output of the control signals to the first solenoid control valve 3 and the second solenoid control valve 4 in step S203, determine whether the data acquisition section 21A receives the cancellation signal (step S209).

When the data acquisition section 21A receives the cancellation signal in step S209 (step S209/YES), the processing proceeds to step S207, and the signal output section 24A cancels the restriction of the output of the control signals to the first solenoid control valve 3 and the second solenoid control valve 4. On the other hand, when the data acquisition section 21A does not receive the cancellation signal in step S209 (step S209/NO), the processing returns to step S203, and the signal output section 24A continues to restrict the output of the control signals to the first solenoid control valve 3 and the second solenoid control valve 4.

As described above, in the present modification, the restriction of the output of the control signals to the first solenoid control valve 3 and the second solenoid control valve 4 is canceled in accordance with the manual operation of the cancellation switch 8 by the operator. Therefore, as compared with the case, for example, the embodiment described above, in which the controller 2 is configured to automatically cancel the restriction of the output of the control signals to the first solenoid control valve 3 and the second solenoid control valve 4 when the engine rotational speed N is equal to or more than the low idle rotational speed NL (NNL), in the present modification, it is possible to prevent the hunting operation of the loading work device 11 caused by repeating the restriction and cancellation of the output of the control signals to the first solenoid control valve 3 and the second solenoid control valve 4.

In the above, the embodiment and modification of the present invention have been descried. The present invention is not limited to the embodiment and modification described above, and includes various other modifications. For example, the embodiment and modification described above have been explained in detail in order to clarify the present invention, but are not necessarily limited to those having all the configurations described above. In addition, a part of the configuration of the present embodiment can be replaced with that of other embodiments, and the configuration of other embodiments can be added to the configuration of the present embodiment. Furthermore, it is possible to add, delete, or replace another configuration with respect to a part of the configuration of the present embodiment.

For example, in the embodiment and modification described above, the controller 2, 2A is configured to restrict the output of the control signals both to the first solenoid control valve 3 and the second solenoid control valve 4. However, depending on the driving states of the lift arm 111 and the bucket 112, the controller 2, 2A may be configured to restrict the output of the control signal to only one of the first solenoid control valve 3 and the second solenoid control valve 4.

In the embodiment and modification described above, a wheel loader has been described as an aspect of work vehicles. However, the present invention is not restricted thereto, and can be applied to other work vehicles such as a hydraulic excavator as long as the vehicle body is equipped with a work device which is operated by an electric operation device.

REFERENCE SIGNS LIST

1: wheel loader (work vehicle)
2, 2A: controller
3: first solenoid control valve
4: second solenoid control valve
5: first directional control valve
5N, 6N: neutral position
6: second directional control valve
7: monitor (display device)
8: cancellation switch (cancellation device)
10: hydraulic oil tank
12: hydraulic pump
13: rotational speed sensor
14: pressure sensor
19: operation lever (operation device)
115: bucket cylinder (hydraulic actuator)
117: lift arm cylinder (hydraulic actuator)
190: engine
NL: low idle rotational speed
Pr: main relief pressure

The invention claimed is:

1. A work vehicle comprising:
a work device attached to a vehicle body;
a hydraulic actuator configured to drive the work device;
a hydraulic pump driven by an engine to supply the hydraulic actuator with hydraulic oil;
a directional control valve configured to control a flow of the hydraulic oil discharged from the hydraulic pump and supplied to the hydraulic actuator;
a hydraulic oil tank for storing the hydraulic oil;
a solenoid control valve configured to supply the directional control valve with a control pressure for controlling and switching the directional control valve;
an electric operation device for operating the work device; and
a controller configured to output a control signal corresponding to an operation amount of the electric operation device to the solenoid control valve,
wherein
the work vehicle includes:
a pressure sensor configured to detect a discharge pressure of the hydraulic pump; and
a rotational speed sensor configured to detect a rotational speed of the engine,
the directional control valve includes a neutral position for causing the hydraulic oil discharged from the hydraulic pump to return to the hydraulic oil tank, and
the controller is configured to, in a case where the discharge pressure detected by the pressure sensor is equal to or more than a relief pressure in a drive circuit of the hydraulic actuator, and the rotational speed detected by the rotational speed sensor is less than a low idle rotational speed that is a rotational speed in a state where the engine is running at a low idle speed, execute restriction of output of the control signal to the solenoid control valve so as to cause the directional control valve to be switched to the neutral position.

2. The work vehicle according to claim 1, wherein
the controller is configured to, after executing the restriction of the output of the control signal to the solenoid control valve, in a case where the rotational speed detected by the rotational speed sensor becomes equal to or more than the low idle rotational speed, cancel the restriction of the output of the control signal to the solenoid control valve.

3. The work vehicle according to claim 1, further comprising a cancellation device configured to output, to the controller, a cancellation signal for cancelling the restriction of the control signal to the solenoid control valve, wherein the controller is configured to, after executing the restriction of the output of the control signal to the solenoid control valve, in a case of receiving the cancellation signal output from the cancellation device, cancel the restriction of the output of the control signal to the solenoid control valve.

4. The work vehicle according to claim 1, wherein the controller further includes a display device for displaying, as an advice display, that the controller is executing the restriction of the output of the control signal to the solenoid control valve, and the controller is configured to, in a case of executing the restriction of the output of the control signal to the solenoid control valve, output a display signal for displaying the advice display to the display device.

* * * * *